US007402079B2

(12) United States Patent
Yang

(10) Patent No.: US 7,402,079 B2
(45) Date of Patent: Jul. 22, 2008

(54) ELECTRICAL CONNECTOR

(75) Inventor: Meng-Huan Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/646,842

(22) Filed: Dec. 27, 2006

(65) Prior Publication Data

US 2007/0149009 A1 Jun. 28, 2007

(30) Foreign Application Priority Data

Dec. 28, 2005 (TW) ..... 20140521 A

(51) Int. Cl.
*H01R 13/648* (2006.01)

(52) U.S. Cl. ..... 439/607; 439/71

(58) Field of Classification Search ..... 439/607, 439/70, 71, 68, 108
See application file for complete search history.

(56) References Cited

U.S. PATENT DOCUMENTS

| | | | | |
|---|---|---|---|---|
| 6,022,239 | A * | 2/2000 | Wright | 439/354 |
| 6,095,862 | A * | 8/2000 | Doye et al. | 439/607 |
| 6,655,995 | B1 * | 12/2003 | Reisinger et al. | 439/607 |
| 6,926,551 | B1 * | 8/2005 | Schulz et al. | 439/357 |
| 6,939,172 | B2 * | 9/2005 | Lu | 439/607 |
| 6,991,494 | B1 * | 1/2006 | Spink, Jr. | 439/607 |
| 7,077,664 | B1 * | 7/2006 | Wang et al. | 439/70 |

* cited by examiner

*Primary Examiner*—Hien Vu
(74) *Attorney, Agent, or Firm*—Wei Te Chung

(57) ABSTRACT

An electrical connector (100) adapted to receive an electronic module (4) has a shield (1) with a number of resilient locking members (123). The resilient locking member (123) further has a cantilever (1232) abutting the electronic module (4). The locking member (123) holds the electrical module (4) firmly while allowing easy access to the module (4).

9 Claims, 5 Drawing Sheets

ELECTRICAL CONNECTOR

BACKGROUND OF THE INVENTION

1. Field of the Invention

The present invention relates generally to an electrical connector in which an electronic module is received.

2. Description of Prior Art

With the development trend of miniature and multifunctional electronic devices, consumer electronics devices such as cell phone, Personal Digital Assistant (PDA) etc., are designed to provide camera module for capturing pictures. Therefore, there is a demand employing socket connectors to mount the camera module to those electronics devices.

A CN Patent No. 2687894, issued on Mar. 23, 2005, discloses such a connector. The connector comprises an insulated base, a number of U-shaped contacts mounted in the insulated base, and a shield encompassing the insulated base so that a space is formed to receive a camera module. The contact has a securing portion received in the insulated base, and a contact portion folded from the securing portion and extending beyond the insulated base for electrical connection to a corresponding pad of the camera module. The shielding is stamped from an integral metallic piece and has four continuous shielding walls, each of which has a number of openings and retaining tabs or arms formed in the opening and extending into the receiving space for holding the camera module.

However, the retaining arms are ineffective from shock of the electronic device. Further, the retaining arms are inconvenient to rework the defective camera module.

Therefore, it is desirable to provide an electrical modular connector to overcome the aforementioned disadvantages.

SUMMARY OF THE INVENTION

It is therefore an object of the present invention to provide an electrical connector holding the camera module firmly.

It is another object of the present invention to provide an electrical connector with improved locking structure.

It is further object of the present invention to provide an electrical connector which is easy to rework.

In order to achieve such objects set forth, an electrical connector adapted for receiving an electronic module comprises a metallic shield. The shield includes a plurality of walls defining a receiving space therebetween. At least one wall has a locking member, the locking member including a pair of resilient arms, an end portion connecting said arms, and a cantilever extending inwardly from the said end portion and located in the receiving space. The electrical connector further has an insulated base assembled in the shield and a plurality of contacts secured on the insulated base.

These and other objects, features and advantages of the present invention will be clearly understand through consideration of the following description.

BRIEF DESCRIPTION OF THE DRAWING

The features of the present invention which are believed to be novel are set forth with particularity in the appended claims. The present invention, together with its objects and the advantages thereof, may be best understood by reference to the following description taken in conjunction with the accompanying drawings in which:

DESCRIPTION OF THE PREFERRED EMBODIMENT

Reference will now be made in detail to a preferred embodiment of the present invention.

Figure 1:
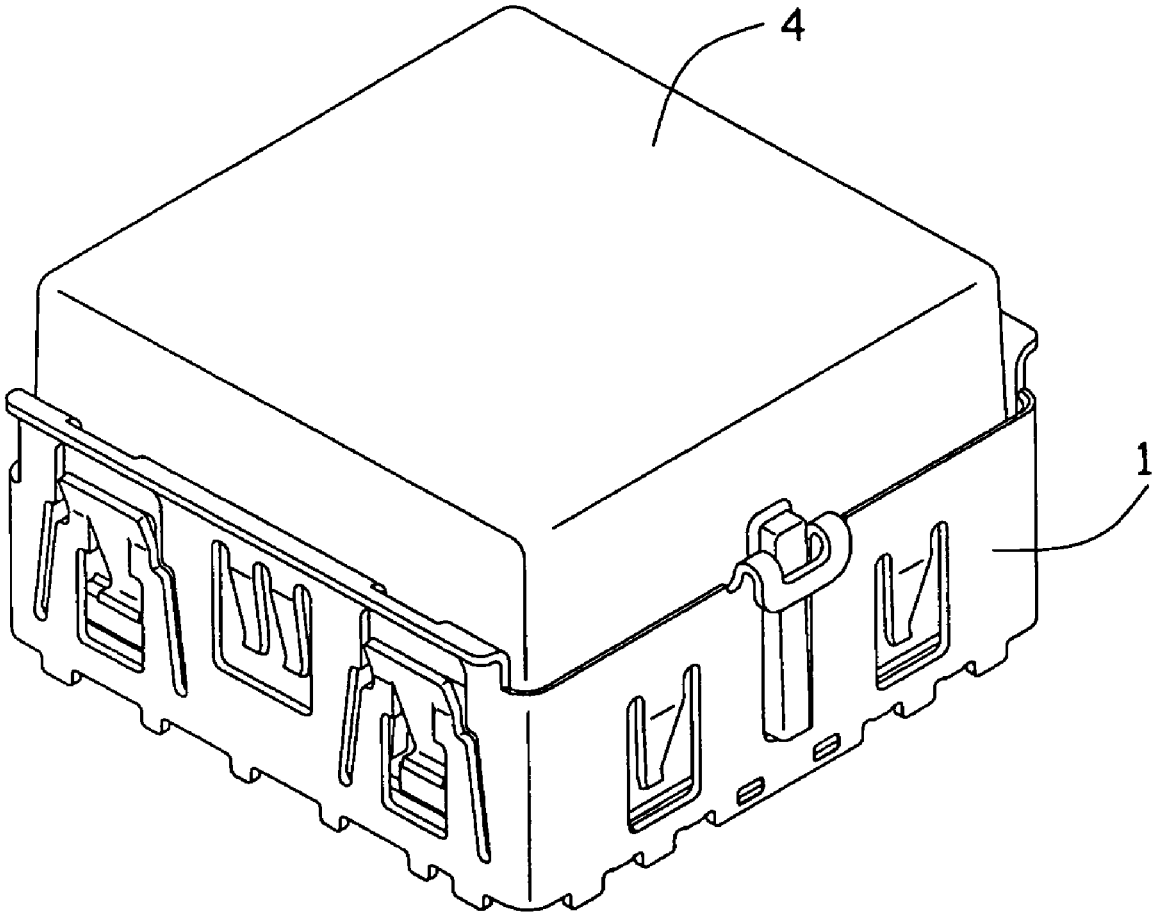
FIG. 1 is a perspective view of an electrical connector in accordance with the principle of the present invention, in which a camera module is demonstrated.
Figure 2:
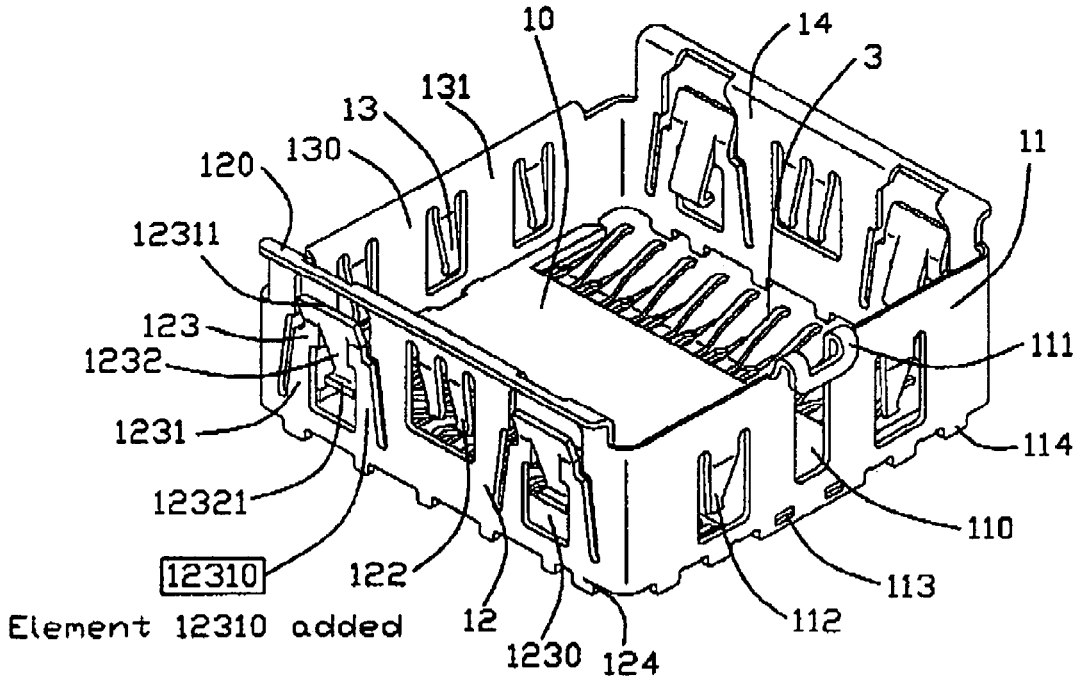
FIG. 2 is a perspective view of the electrical connector.

Referring to FIGS. 1 and 2, an electrical connector 100 according to the present invention is adapted for receiving an electronic module 4, which is a camera module 4 in the preferred embodiment. The electrical connector 100 comprises a shield 1 accommodating said camera module 4, a insulated base 2 retained at the bottom of the shield 1, and a plurality of contacts 3 secured in the insulated base 2.

Figure 3:
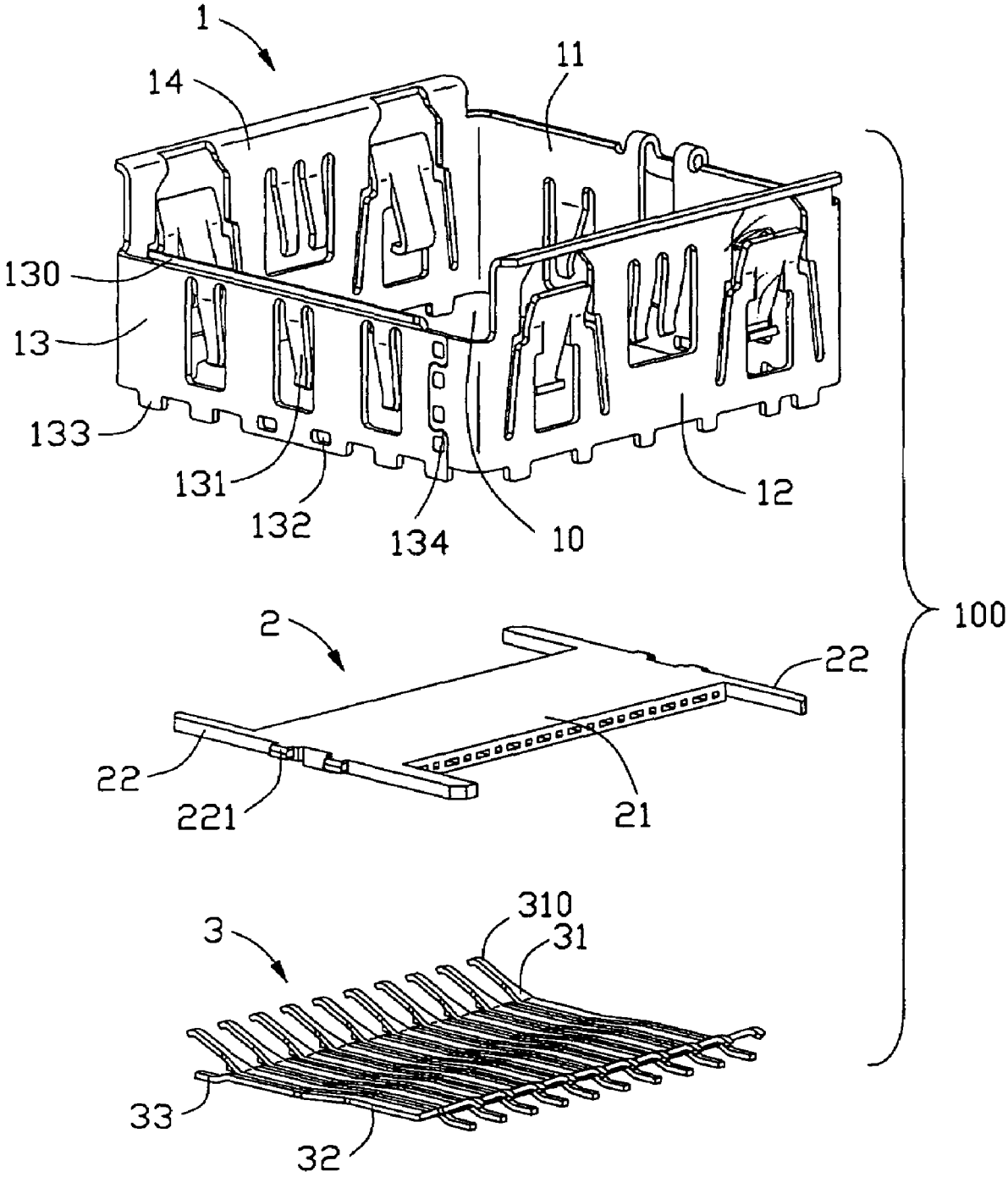
FIG. 3 is an exploded view of the electrical connector.
Figure 4:
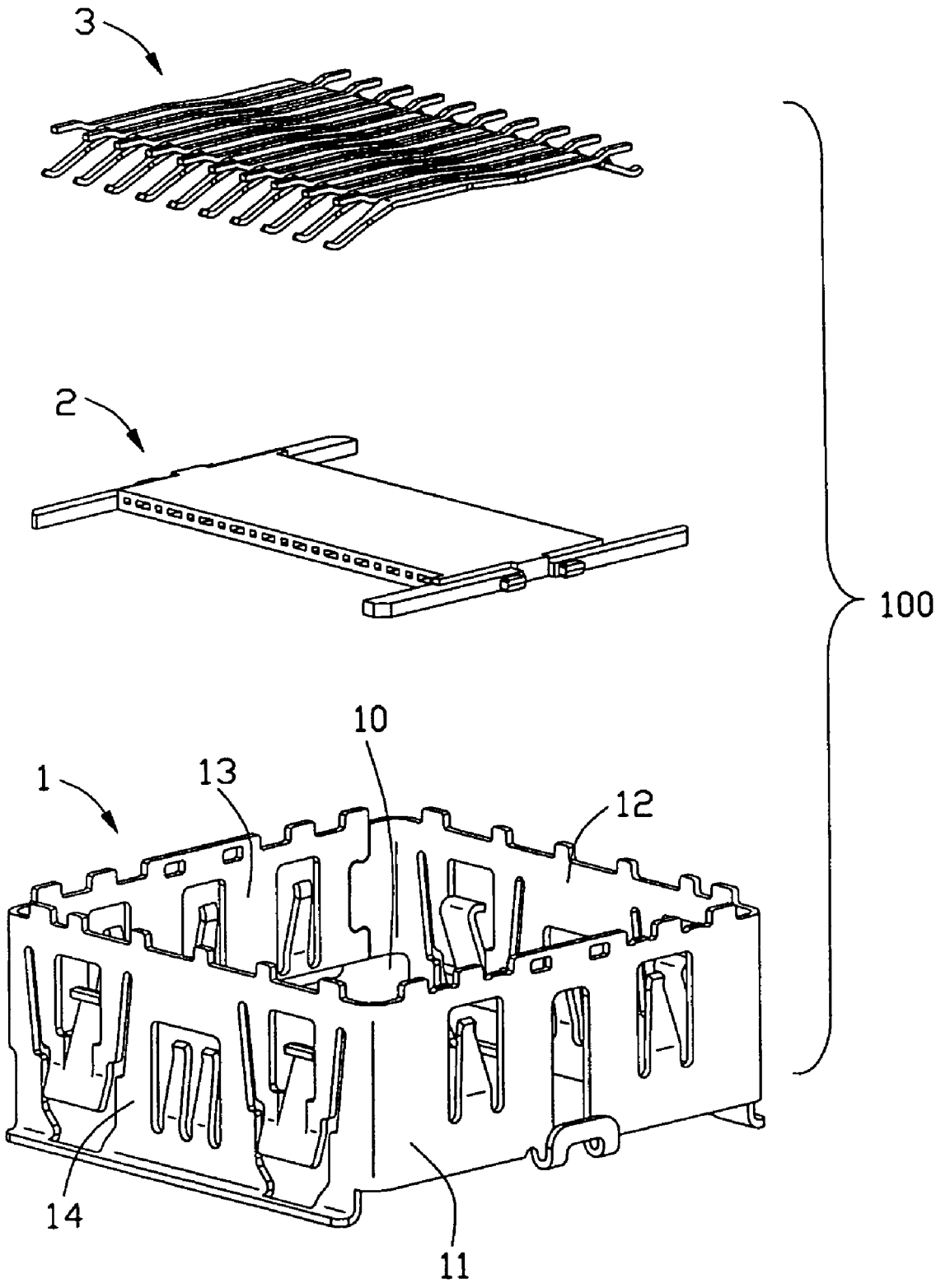
FIG. 4 is another exploded view of the electrical modular connector.

Referring to FIG. 2 and FIG. 3, the shield 1 will be described in detail. The shield 1 is stamped from a metallic sheet and bent to form a rectangular configuration as shown in the present invention. The shield 1 comprises a first wall 11, a second wall 12, a third wall 13 and a fourth wall 14, which are connected together to form a receiving space 10.

The first wall 11 includes a cutout 110 defined at center section, an ear portion 111 extending from the upper edge (not labeled) of the first wall 11 around the cutout 110 and folded outwardly and downwardly, a pair of resilient tab 112 symmetrically located at two opposite sides of the cutout 110, a pair of apertures 113 formed below the cutout 110, and a plurality of terminals 114 defined at the low edge of the first wall 11. The resilient tabs 112 each have a distal end (not labeled) that extends into the receiving space 10 for abutting the camera module 4. The ear portion 111 makes the cutout 110 closed and free from distortion. The ear portion 111 also guides the camera module 4 when mounted into the electrical connector 100.

The second wall 12 and the fourth wall 14 face oppositely and has the same construction, therefore, only the second wall 12 will be described in detail for simplicity. The second wall 12 includes a guiding portion 120 folded outwardly at the upper edge, a pair of resilient tabs 122 defined at center section of the second wail 12 and extending downwardly from the guiding portion 120 toward the receiving space 10, a pair of resilient locking members 123 symmetrically defined at two opposite sides of the resilient tabs 122, and a plurality of terminals 124 formed at the lower edge of the second wall 22. The resilient locking member 123 has resilient base portion 1231 and a cantilever 1232 extending from the base portion 1231 in substantially opposite direction. The base portion 1231 includes a pair of spaced resilient arms 12310 upwardly extending from the lower edge of the second wall 12 adjacent to the terminals 124, and an end portion 12311 connecting the resilient arms 12310. The pair of resilient arms 1231 and the end portion 12311 form an opening 1230 so that the cantilever 1232 can move therein. The cantilever 1232 extends from the lower edge of the end portion 12311 of the base portion 1231 and has a distal end 12321. The distal end 12321 extends into the receiving space 10 for retaining the camera module 4 and is crimped outwardly for easy reworking.

The third wall 13 has three resilient tabs 131 equally spaced thereon, a pair of apertures 132 located below the resilient tabs 131, and a plurality of terminals 133 formed on the lower edge. The third wall 13 further has a swallow-tail shaped jointing line 134 formed adjacent to the resilient tab 131 so as to connect all the four walls 11, 12, 13, 14 together.

The insulated base 2 includes a longitudinal base portion 21 and a pair of arms 22 oppositely extending from each longitudinal edge of said base portion 21. The base portion 21 has a plurality of passageways extending through the base portion 21 in the lateral direction. The base portion 21 further has a pair of protrusions 221 on each longitudinal edge that mate with the corresponding apertures 113, 132 of the first wall 11 and the third wall 13, so that the insulated base 2 is retained at the bottom of the shield 1.

The contact 3 includes a body portion 32 secured in the base portion 21 of the insulated base 2, a contacting portion 31 extending beyond the base portion 21 for connecting to a pad of the camera module 4, and soldering portion 33 extending below the base portion 21 for connecting to a printed circuit board on which the connector 100 is mounted. The contacting portion 32 and the soldering portion 33 of a contact are situated on opposite sides of the base portion 21 of the insulated base 2 in the latitudinal direction. However, the contacting portions 31 of adjacent contacts 3 are located at different sides of the base portion 21.

Figure 5:
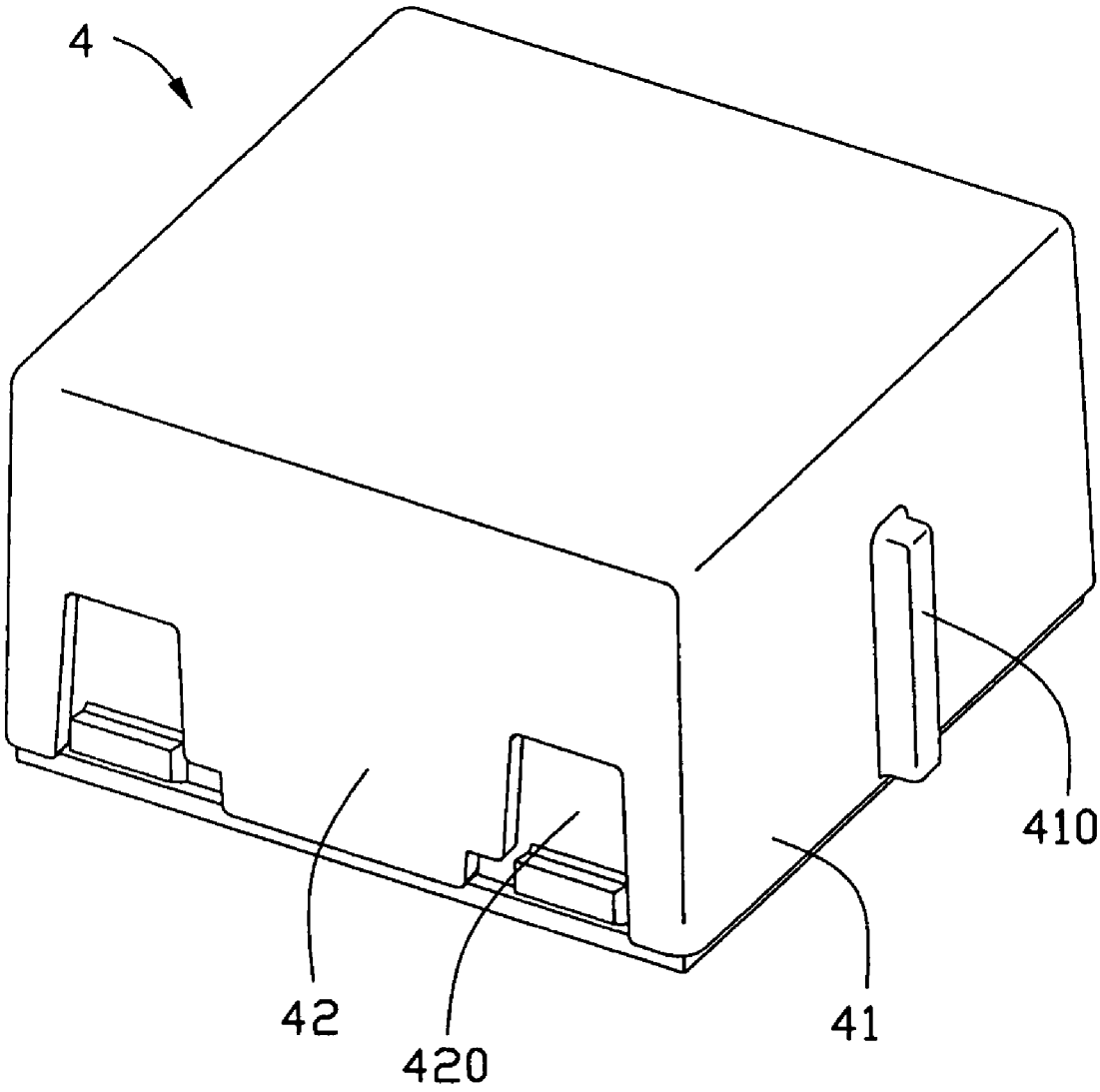
FIG. 5 is a perspective view of the camera module.

Now referring to FIG. 5, the camera module 4 illustrates basic structure of a camera used in cell phone, PDA, and the like. The camera module 4 has two sidewalls 41, a front wall 42, and a rear wall same as the front wall 42. One of the sidewalls 41 has a bulge 410, which inserts into the cutout 110 of the shielding 1. A pair of recesses 420 is formed at the bottom portion of the front wall 42 into which the distal end 12321 of the locking member 123 extends when the camera module is assembled in the connector 100.

When the camera module 4 is inserted into the connector 100, the bulge 410 is received in the cutout 110 of the shield 1 and the lower end of the bulge 410 sits on the lower edge of cutout 110, the distal end 12321 extends into the recess 420, and the resilient tabs 112, 122 131 on each wall 11, 12, 13, 14 of the shielding 1 abut against the camera module 4, which provides retaining force in six directions such that the camera module is mounted in the connector 100 firmly. As the cantilever 1232 superposes on the base portion 1231, the locking provides sufficient biasing force, and ease of reworking on the camera module 4.

While the preferred embodiment of the invention have been shown and described, it will be apparent to those skilled in the art that changes and modifications may be made therein without departing from the spirit of the invention, the scope of which is defined by the appended claims.

The invention claimed is:

1. An electrical connector adapted for receiving an electronic module, comprising:

a metallic shield comprising a plurality of walls defining a receiving space therebetween, at least one of said walls having a resilient locking member outwardly stamped therefrom, said resilient locking member having a cantilever extending into said receiving space;

an insulated base assembled to said shield and having an elongate base portion and a respective pair of elongated aims extending laterally from one of two longitudinal ends thereof; and a plurality of contacts positioned in said base portion, each of said contacts having a body portion, a contacting portion positioned at one end of the body and a soldering portion positioned at the other end of the body portion, said contacting portion of each contact is staggeringly arranged with the soldering portion of an adjacent contact and extended outwardly from opposite sides of said body portion;

wherein said resilient locking member has a pair of spaced resilient arms upwardly extending from a lower portion thereof and an end portion connecting said arms;

wherein said cantilever extends from said end portion between said pair of resilient arms.

2. An electrical connector as claimed in claim 1, wherein said cantilever has a crimped distal end extending into the receiving space for retaining the camera module.

3. An electrical connector as claimed in claim 1, wherein said shield is formed from one piece of metal sheet.

4. An electrical connector as claimed in claim 1, wherein at least one of said walls has a cutout and an ear portion extending from an upper edge thereof around said cutout.

5. An electrical connector as claimed in claim 1, wherein each of said walls of said shielding has at least one retaining tab.

6. An electrical connector assembly, comprising:

an electronic module;

a socket comprising:

a metallic shield comprising a plurality of walls commonly defining a receiving space therebetween, at least one of said walls having a resilient locking member from a lower portion thereof, said resilient locking member having a downward cantilever extending into said receiving space;

an insulated bar assembled to said shield and having an base portion and a respective pair of elongated arms extending laterally from one of two longitudinal ends thereof;

a plurality of contacts positioned in said base portion, each of said contacts having a body portion, a contacting portion positioned at one end of the body and a soldering portion positioned at the other end of the body portion, said contacting portion of each contact is staggeringly arranged with the soldering portion of an adjacent contact and extended outwardly from opposite sides of said body portion; and wherein the resilient locking member defines manual operation area at an upper section thereof, and having a pair of spaced resilient arms upwardly extending from a lower portion thereof.

7. The assembly as claimed in claim 6, wherein the resilient locking member is essentially an upward cantilever rooted at the lower portion of the one of said walls.

8. The assembly as claimed in claim 6, wherein the resilient locking is essentially located in an opening in said one of the walls.

9. The assembly as claimed in claim 8, wherein an end portion of said one of the walls is located above the resilient locking member.

* * * * *